US011795669B2

(12) United States Patent
Chen

(10) Patent No.: US 11,795,669 B2
(45) Date of Patent: Oct. 24, 2023

(54) METHOD FOR MOUNTING FAUCET ASSEMBLY

(71) Applicants: Zhilin Chen, Zhejiang (CN); Xianxiang Chen, Zhejiang (CN)

(72) Inventor: Xianxiang Chen, Zhejiang (CN)

(73) Assignees: Xianxiang Chen, Taizhou (CN); Zhilin Chen, Taizhou (CN)

( * ) Notice: Subject to any disclaimer, the term of this patent is extended or adjusted under 35 U.S.C. 154(b) by 26 days.

(21) Appl. No.: 17/628,215

(22) PCT Filed: Jun. 1, 2020

(86) PCT No.: PCT/CN2020/093786

§ 371 (c)(1),
(2) Date: Jan. 18, 2022

(87) PCT Pub. No.: WO2021/017616

PCT Pub. Date: Feb. 4, 2021

(65) Prior Publication Data

US 2022/0251812 A1 Aug. 11, 2022

(30) Foreign Application Priority Data

Jul. 30, 2019 (CN) ..... 201910696305.3

(51) Int. Cl.
*E03C 1/04* (2006.01)

(52) U.S. Cl.
CPC ..... *E03C 1/0402* (2013.01)

(58) Field of Classification Search
CPC .... E03C 1/0402; E03C 1/0401; E03C 1/0403; E03C 2001/0416; Y10T 137/6014
See application file for complete search history.

(56) References Cited

U.S. PATENT DOCUMENTS

| | | | | |
|---|---|---|---|---|
| 10,662,626 | B2 * | 5/2020 | Lin | E03C 1/0402 |
| 2012/0137427 | A1 * | 6/2012 | Li | E03C 1/0402 4/695 |

FOREIGN PATENT DOCUMENTS

| | | | | |
|---|---|---|---|---|
| CN | 104452897 | A | 3/2015 | |
| CN | 206681085 | U | 11/2017 | |
| CN | 107524859 | A | 12/2017 | |
| CN | 108060702 | A * | 5/2018 | E03C 1/0401 |
| CN | 108060702 | A | 5/2018 | |
| JP | 2012202514 | A * | 10/2012 | |

OTHER PUBLICATIONS

International search report of PCT Patent Application No. PCT/CN2020/093786 dated Aug. 24, 2020.

* cited by examiner

*Primary Examiner* — Erin Deery

(57) ABSTRACT

The present invention provides a method for mounting a faucet assembly comprising: extending and passing a water duct of a faucet through a base, and connecting the water duct to a fixing plate, wherein a size of the fixing plate is larger than a size of the base; extending and passing the water duct through a mounting hole of a mounting table, and mounting and fixing the base to the mounting hole; removing the water duct from the fixing plate, and mounting the water duct to the faucet; and mounting the faucet to the base. The object of the present invention is to provide a method for mounting a faucet assembly, so that a water duct of a faucet is less likely to fall during the mounting process, thereby improving the mounting efficiency of the faucet assembly.

10 Claims, 7 Drawing Sheets

METHOD FOR MOUNTING FAUCET ASSEMBLY

FIELD OF THE APPLICATION

The present invention relates to the field of sanitary appliance, and more specifically, to a method for mounting a faucet assembly.

BACKGROUND OF THE APPLICATION

In the current process for mounting a faucet assembly, because a water duct of a faucet has no fixing device, the water duct often slips from a mounting hole of a base or a mounting table during the mounting process. In addition, because an underside of the table is small and usually invisible, it is difficult to remount the water duct. Therefore, it is urgent to improve the method for mounting a faucet assembly to improve mounting efficiency of the faucet assembly.

SUMMARY OF THE APPLICATION

The object of the present invention is to provide a method for mounting a faucet assembly, so that a water duct of a faucet is less likely to fall during the mounting process, thereby improving the mounting efficiency of the faucet assembly.

The present invention provides a method for a mounting faucet assembly, comprising: extending and passing a water duct of a faucet through a base, and connecting the water duct to a fixing plate, wherein a size of the fixing plate is larger than a size of the base; extending and passing the water duct through a mounting hole of a mounting table, and mounting and fixing the base to the mounting hole; removing the water duct from the fixing plate, and mounting the water duct to the faucet; and mounting the faucet to the base.

According to an embodiment of this application, the method further comprises: before the extending and passing the water duct through a mounting hole of a mounting table, extending and passing a screw through the base, and screwing the screw to a mounting plate.

According to an embodiment of this application, wherein the extending and passing the water duct through a mounting hole of a mounting table further comprises: first extending and passing the water duct through a sealing ring, and then extending and passing the water duct through the mounting hole of the mounting table, wherein the sealing ring is located between the mounting table and the base.

According to an embodiment of this application, wherein the extending and passing the water duct through a mounting hole of a mounting table comprises: extending and passing the water duct through the mounting hole of the mounting table from top to bottom; and the mounting and fixing the base to the mounting hole comprises: mounting and passing the mounting plate through the mounting hole of the mounting table, so that the mounting plate is located on an underside of the mounting table, and the base is located on a top surface of the mounting table.

According to an embodiment of this application, wherein the method further comprises: before the removing the water duct from the fixing plate, tightening the screw, so that the base is clamped on both sides of the mounting table.

According to an embodiment of this application, wherein the mounting the water duct to the faucet comprises: first pulling up the water duct to a predetermined height, then removing the water duct) from the fixing plate, and then mounting the water duct to the faucet.

According to an embodiment of this application, wherein the faucet is mounted and fixed to the base by using a fastener.

According to an embodiment of this application, wherein the fixing plate is rectangular, and a length of the fixing plate is greater than a diameter of the base.

According to an embodiment of this application, wherein there are at least two water ducts.

According to an embodiment of this application, wherein one or two screws are mounted on the base.

The beneficial technical effects of the present invention are: In the method for mounting a faucet assembly provided in this application, before extending and passing the water duct through a mounting hole, the water duct is connected to the fixing plate whose size is larger than that of the base. Even if the water duct is dropped, the fixing plate may be clamped on the base so that the water duct will not fall into the underside of the mounting table. Moreover, connecting the water duct to the fixing plate also facilitates a mounter to perform mounting operations on a plurality of water ducts at the same time, without always paying attention to whether the water duct falls. Therefore, this application greatly improves the mounting efficiency of the faucet assembly.

BRIEF DESCRIPTION OF THE ACCOMPANYING DRAWINGS

DETAILED DESCRIPTION OF THE PREFERRED EXAMPLES

This application is described with reference to the accompanying drawings; however, it should be understood that the following are only optional implementations of this application, and do not constitute any limitation to this application.

Figure 1:
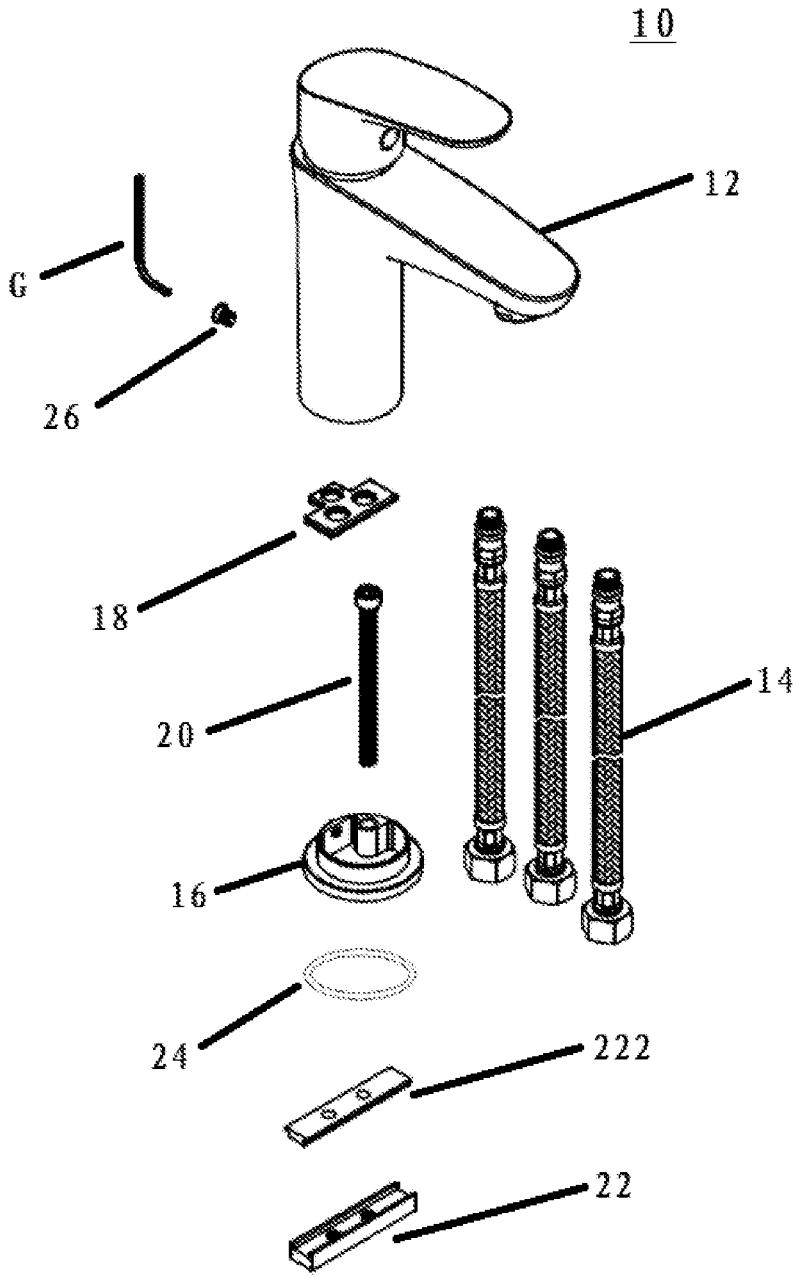
FIG. 1 is an exploded view of a faucet assembly according to an embodiment of this application.
Figure 7:
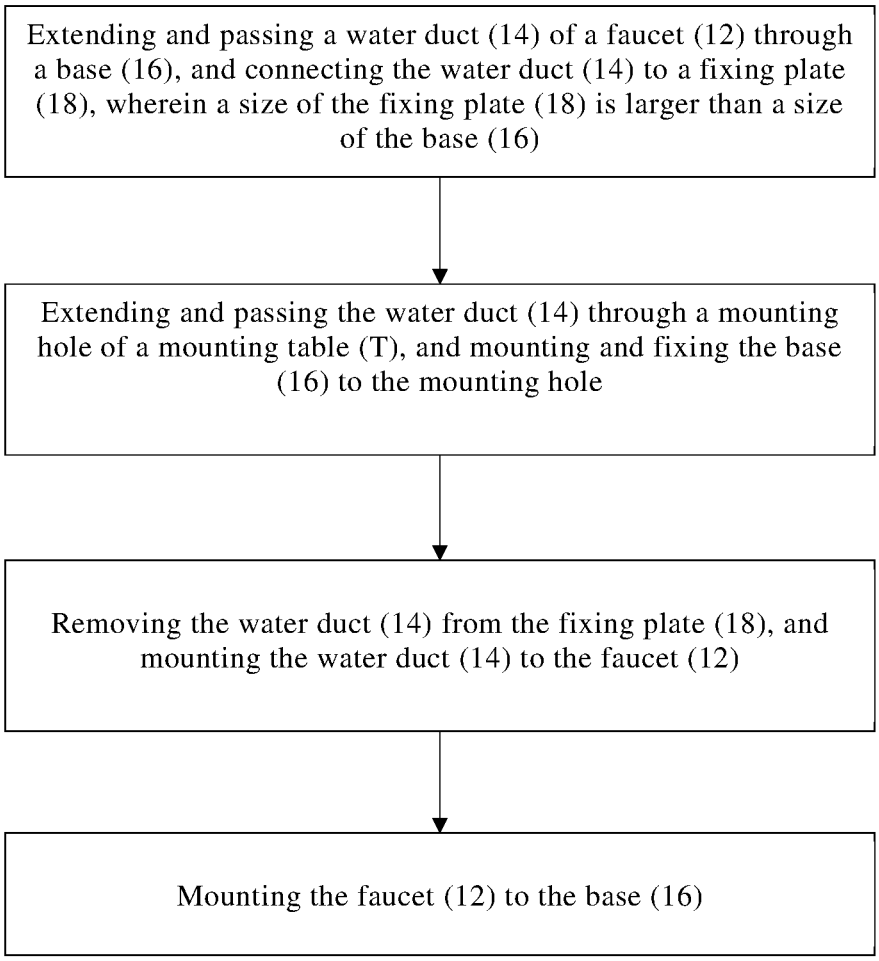
FIG. 7 is a flowchart of a method for mounting a faucet assembly according to an embodiment of this application.

The present invention provides a method for mounting a faucet assembly 10. As shown in FIG. 1 and FIG. 7, the method includes: first extending and passing a water duct 14 of a faucet 12 through a base 16, and connecting the water duct 14 to a fixing plate 18; then extending and passing the water duct 14 through a mounting hole of a mounting table T, and mounting and fixing the base 16 to the mounting hole; then removing the water duct 14 from the fixing plate 18, and mounting the water duct 14 to the faucet 12; finally mounting the faucet 12 to the base 16.

In this embodiment, a size of the fixing plate 18 is larger than a size of the base 16. Therefore, when the water duct 14 falls or slips off, the fixing plate 18 may be stuck on the base 16. Connecting the water duct 14 to the fixing plate 18 may facilitate mounting work performed by a mounter and improve mounting efficiency.

In an embodiment of the present invention, the method further includes: before the extending and passing the water duct 14 through a mounting hole of a mounting table T, extending and passing a screw 20 through the base 16, and screwing the screw to a mounting plate 22.

In this embodiment, the screw 20 is screwed to the mounting plate 22, so that the connection between the base 16 and the mounting table T is detachable, and a clamping degree between the base 16 and the mounting table may also be adjusted. Moreover, mounting and fixing operations between the base 16 and the mounting table T may be directly performed on a top surface of the mounting table T by providing the screw 20 and the mounting plate 22 without being performed at the bottom of the mounting table T.

In an embodiment of the present invention, the extending and passing the water duct 14 through a mounting hole of a mounting table T further includes: first extending and passing the water duct 14 through a sealing ring 24, and then extending and passing the water duct 14 through the mounting hole of the mounting table T, where the sealing ring 24 is located between the mounting table T and the base 16.

In this embodiment, the sealing ring 24 is provided so that the sealing between the base 16 and the mounting table T is good and not easy to slide relative to each other.

In an embodiment of the present invention, the extending and passing the water duct 14 through a mounting hole of a mounting table T includes: extending and passing the water duct 14 through the mounting hole of the mounting table T from top to bottom; and the mounting and fixing the base 16 to the mounting hole includes: mounting and passing the mounting plate 22 through the mounting hole of the mounting table T, so that the mounting plate 22 is located on an underside of the mounting table T, and the base 16 is located on a top surface of the mounting table T.

In this embodiment, extending and passing the water duct 14 through the mounting hole of the mounting table T from top to bottom may avoid the water duct 14 from being extended and inserted upward from the bottom of the mounting table T with a small space. This greatly improves operability and convenience. On the other hand, as shown in FIG. 5 and FIG. 6, mounting and passing the mounting plate 22 through the mounting hole of the mounting table T is beneficial for the base 16 to clamp the mounting table T after the water duct 14 extends and passes through the mounting hole.

In an embodiment of the present invention, the method further includes: before the removing the water duct 14 from the fixing plate 18, tightening the screw 20, so that the base 16 is clamped on both sides of the mounting table T.

Figure 5:
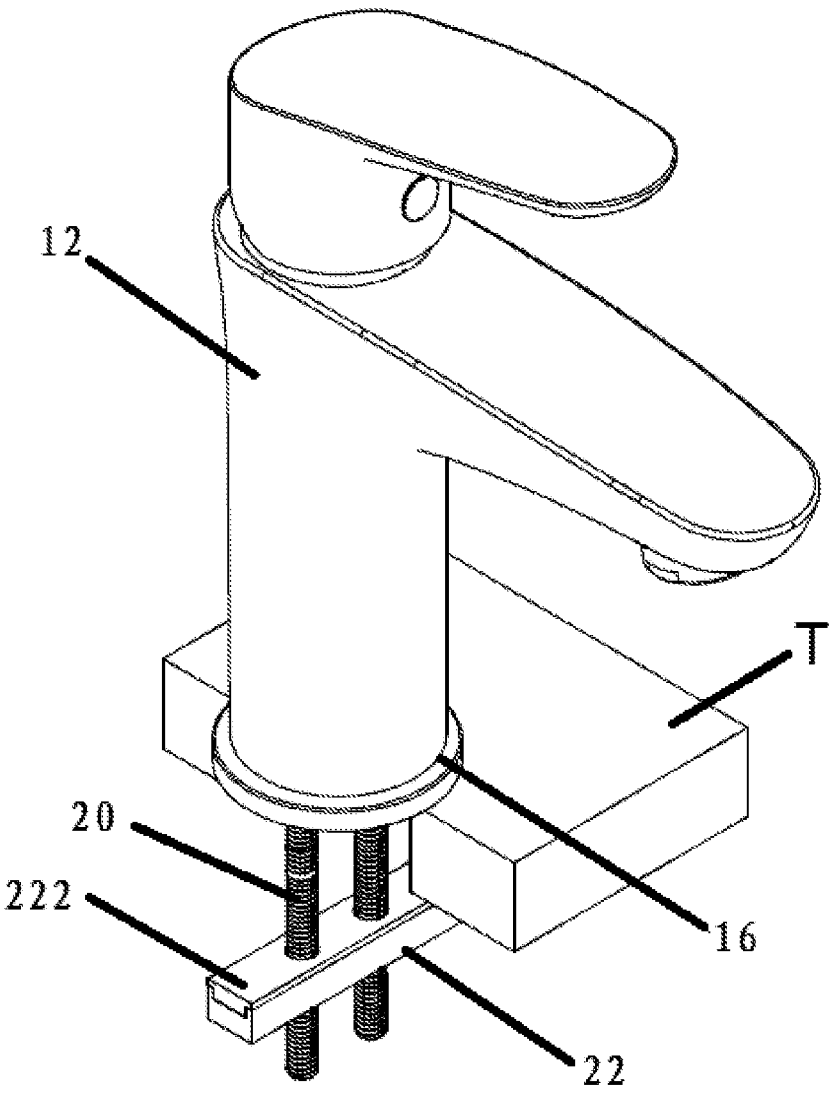
FIG. 5 is a schematic diagram of a mounted faucet assembly according to an embodiment of this application.
Figure 6:
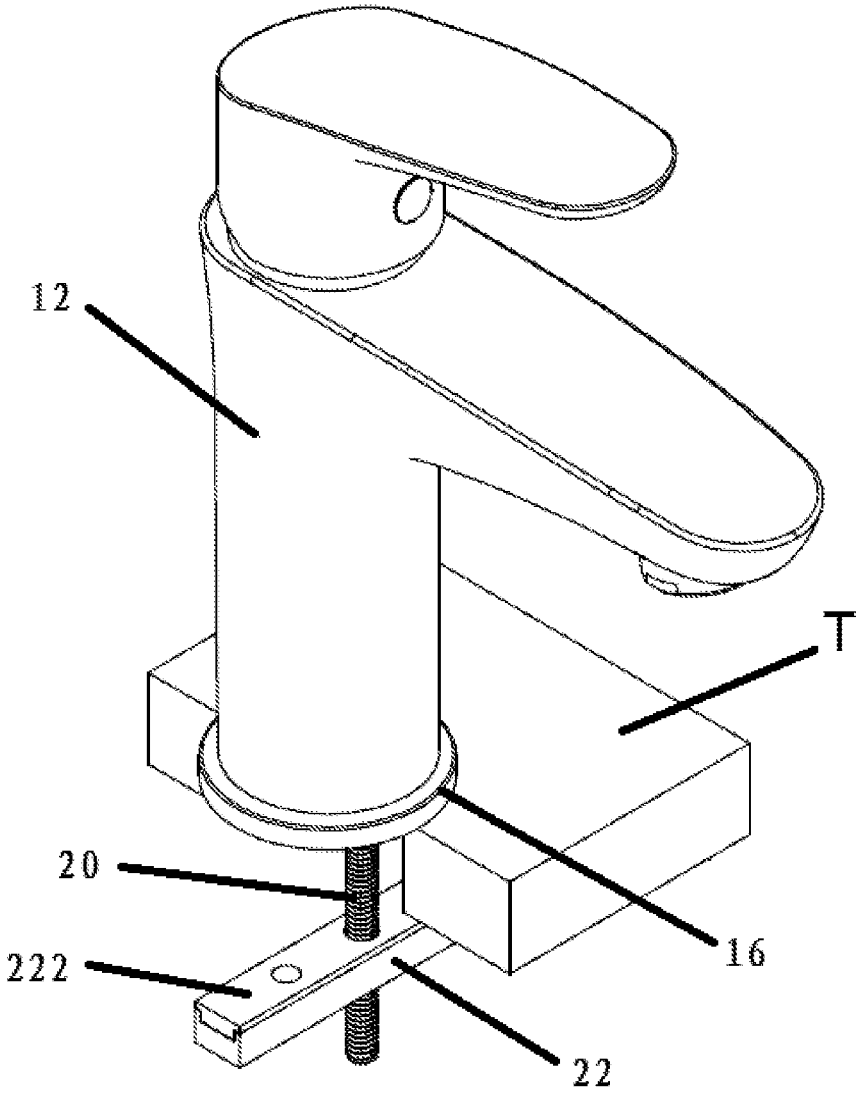
FIG. 6 is a schematic diagram of a mounted faucet assembly according to another embodiment of this application.

In this embodiment, as shown in FIG. 5 and FIG. 6, the screw 20 are tightened, and the base 16 is clamped on both sides of the mounting table T, so that the base 16 will not shake. Therefore, when the water duct 14 is mounted to the faucet 12, the base 16 is firmly fixed on the mounting table T, so that the water duct 14 will not shake, which improves mounting efficiency.

In this embodiment, the mounting plate 22 includes a gasket 222. The screw 20 passes through the gasket 222 and is connected to the mounting plate 22. When the base 16 is fixed, the gasket 222 is located between the underside of the mounting table T and the mounting plate 22, which helps prevent the mounting plate 22 from sliding relative to the mounting table T.

In an embodiment of the present invention, the mounting the water duct 14 to the faucet 12 includes: first pulling up the water duct 14 to a predetermined height, then removing the water duct 14 from the fixing plate 18, and then mounting the water duct 14 to the faucet 12.

In this embodiment, the base 16 has been fixed on the mounting table T, and the mounter may focus on mounting the water duct. Moreover, because the fixing plate 18 may be connected to a plurality of water ducts 14, when one water duct 14 is mounted, other water ducts 14 will not fall.

In an embodiment of the present invention, the faucet 12 is mounted and fixed to the base 16 by using a fastener 26.

In this application, the fastener 26 is a screw. However, in other embodiments, the fastener 26 may be a rivet, a snap, or the like. In some embodiments, the faucet 12 may be screwed to the base 16.

In an embodiment of the present invention, the fixing plate 18 is rectangular, and a length of the fixing plate 18 is greater than a diameter of the base 16.

In other embodiments, the fixing plate 18 may be of other shapes, such as round, semicircle, triangular, or even special-shaped, as long as the fixing plate 18 can be clamped on the base 16. In some embodiments, the fixing plate 18 is screwed to the water duct 14, and the fixing plate 18 is provided with threaded holes. The number of the threaded holes may be flexibly set according to the number of water ducts 14 to be connected, for example, two, three, or five threaded holes may be set.

In an embodiment of the present invention, there are at least two water ducts 14. In other embodiments, there may be three or more water ducts 14.

In an embodiment of the present invention, one or two screws 20 are mounted on the base 16. In this embodiment, only one screw 20 is mounted to make the mounting process very simple and efficient; and two screws 20 are mounted, so that the base 16 can be clamped on both sides of the mounting table T more firmly.

The method for mounting a faucet assembly of the present invention will be described in detail below in accordance with the accompanying drawings in the specification.

Firstly, the water duct 14 is extended and passed through the base 16, and then the water duct 14 is connected or mounted to the fixing plate 18.

Then the screw 20 is extended and passed through the base 16, and the screw 20 is connected to the mounting plate 22.

Then the water duct 14 is extended and passed through a sealing ring 24, and the water duct 14 is extended and passed through the mounting hole of the mounting table T. At this time, the sealing ring 24 is located between the base 16 and the mounting table T.

Then the mounting plate 22 is mounted and passed through the mounting hole of the mounting table T, so that the mounting plate 22 is located on the underside of the mounting table T while the base 16 is located on the top surface of the mounting table T. Then the screw 20 is tightened, so that the base 16 is clamped on both sides of the mounting table T.

Then the water duct 14 is pulled up to a certain height. Then the water duct 14 is removed from the fixing plate 18, and the water duct 14 is mounted to the faucet 12.

Finally, the faucet 12 is mounted to the base 16. A tool G is used to firmly fix the faucet 12 on the base 16 with the screw.

Figure 2:
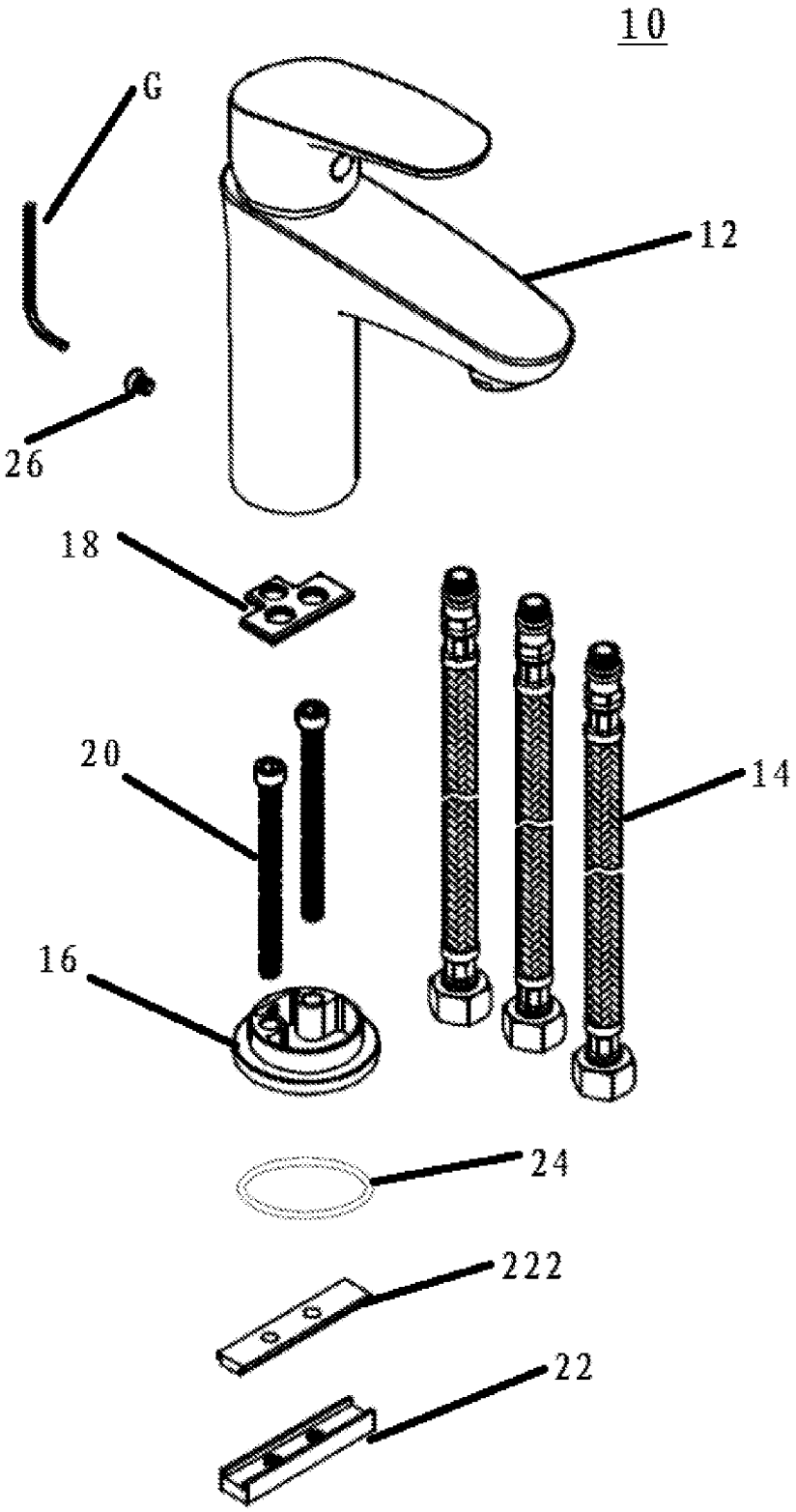
FIG. 2 is an exploded view of a faucet assembly according to another embodiment of this application.
Figure 3:
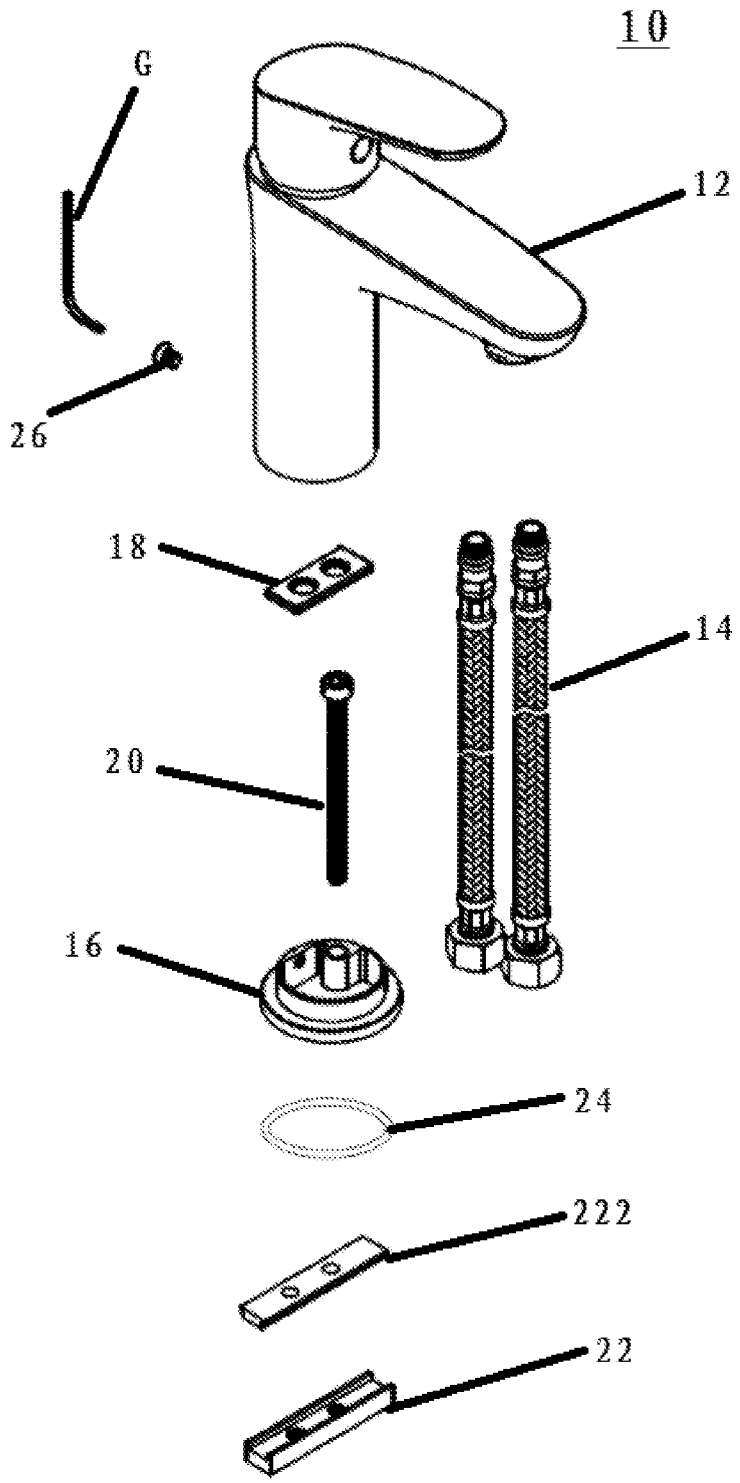
FIG. 3 is an exploded view of a faucet assembly according to another embodiment of this application.
Figure 4:
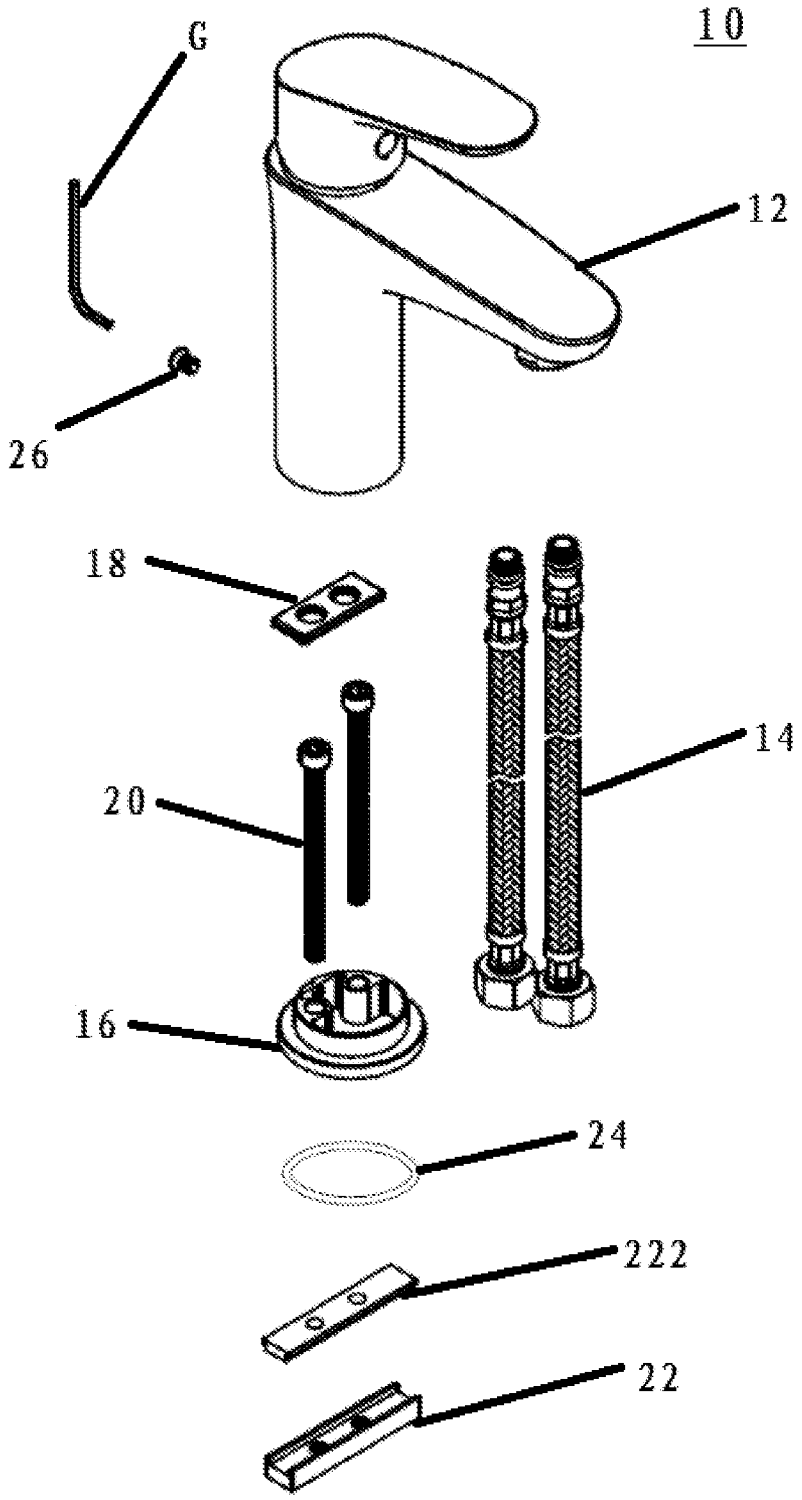
FIG. 4 is an exploded view of a faucet assembly according to another embodiment of this application.

In FIG. 1 of the present invention, the faucet assembly 10 includes three water ducts 14 and one screw 20. In FIG. 2, the faucet assembly includes three water ducts 14 and two screws 20. In FIG. 3, the faucet assembly 10 includes two water ducts 14 and one screw 20. In FIG. 4, the faucet assembly 10 includes two water ducts 14 and two screws 20.

The description above is only preferable embodiments of the present invention, and is not used to limit the present invention. For a person skilled in the art, the present invention may have various modifications and changes. Any modification, equivalent replacement and improvement made within the spirit and principle of the present invention shall be included in the protection scope of the present invention.

What is claimed is:

1. A method for a mounting faucet assembly, comprising:

extending and passing a water duct (14) of a faucet (12) through a base (16), and connecting the water duct (14) to a fixing plate (18), wherein a size of the fixing plate (18) is larger than a size of the base (16);

extending and passing the water duct (14) through a mounting hole of a mounting table (T), and mounting and fixing the base (16) to the mounting hole;

removing the water duct (14) from the fixing plate (18), and mounting the water duct (14) to the faucet (12); and mounting the faucet (12) to the base (16).

2. The method for mounting a-the faucet assembly according to claim 1, wherein the method further comprises: before the extending and passing the water duct (14) through the mounting hole of the mounting table (T), extending and passing a screw (20) through the base (16), and screwing the screw to a mounting plate (22).

3. The method for mounting the faucet assembly according to claim 2, wherein the method further comprises: before the removing the water duct (14) from the fixing plate (18), tightening the screw (20), so that the base (16) is clamped on both sides of the mounting table (T).

4. The method for mounting the faucet assembly according to claim 2, wherein the screw is one screw or two screws (20) mounted on the base (16).

5. The method for mounting the faucet assembly according to claim 1, wherein the extending and passing the water duct (14) through the mounting hole of the mounting table (T) further comprises: first extending and passing the water duct (14) through a sealing ring (24), and then extending and passing the water duct (14) through the mounting hole of the mounting table (T), wherein the sealing ring (24) is located between the mounting table (T) and the base (16).

6. The method for mounting the faucet assembly according to claim 1, wherein the extending and passing the water duct (14) through the mounting hole of the mounting table (T) comprises: extending and passing the water duct (14) through the mounting hole of the mounting table (T) from top to bottom; and the mounting and fixing the base (16) to the mounting hole comprises: mounting and passing the mounting plate (22) through the mounting hole of the mounting table (T), so that the mounting plate (22) is located on an underside of the mounting table (T), and the base (16) is located on a top surface of the mounting table (T).

7. The method for mounting the faucet assembly according to claim 1, wherein the mounting the water duct (14) to the faucet (12) comprises: first pulling up the water duct (14) to a predetermined height, then removing the water duct (14) from the fixing plate (18), and then mounting the water duct (14) to the faucet (12).

8. The method for mounting the faucet assembly according to claim 1, wherein the faucet (12) is mounted and fixed to the base (16) by using a fastener (26).

9. The method for mounting the faucet assembly according to claim 1, wherein the fixing plate (18) is rectangular, and a length of the fixing plate (18) is greater than a diameter of the base (16).

10. The method for mounting the faucet assembly according to claim 1, wherein the water duct is at least two water ducts (14).

* * * * *